US008018334B1

(12) United States Patent
DiMartino et al.

(10) Patent No.: US 8,018,334 B1
(45) Date of Patent: Sep. 13, 2011

(54) PROXIMITY DETECTION AND ALERTING

(75) Inventors: Allison A. DiMartino, Overland Park, KS (US); Jason R. Delker, Olathe, KS (US); John M. Everson, Leawood, KS (US); Jason K. Whitney, Lee's Summit, MO (US)

(73) Assignee: Sprint Communications Company L.P., Overland Park, KS (US)

( * ) Notice: Subject to any disclaimer, the term of this patent is extended or adjusted under 35 U.S.C. 154(b) by 0 days.

(21) Appl. No.: 12/907,014

(22) Filed: Oct. 18, 2010

Related U.S. Application Data

(63) Continuation of application No. 12/116,046, filed on May 6, 2008, now Pat. No. 7,843,327.

(51) Int. Cl.
*G08B 1/08* (2006.01)

(52) U.S. Cl. ..... 340/539.11; 340/539.15; 340/539.21; 340/505; 340/573.1; 340/573.4; 340/577; 340/692; 340/815.45; 455/456.1; 455/456.6; 70/14; 70/18; 70/30; 70/49; 70/58

(58) Field of Classification Search ..... 340/539.11, 340/539.15, 539.21, 505, 573.1, 573.4, 577, 340/692, 815.45; 455/456.1, 456.6; 70/14, 70/18, 30, 49, 58
See application file for complete search history.

(56) References Cited

U.S. PATENT DOCUMENTS

| | | | | |
|---|---|---|---|---|
| 4,675,656 | A | 6/1987 | Narcisse | |
| 4,785,291 | A | 11/1988 | Hawthorne | |
| 5,963,131 | A * | 10/1999 | D'Angelo et al. | 340/568.1 |
| 7,009,512 | B2 * | 3/2006 | Cordoba | 340/539.23 |
| 7,218,221 | B2 * | 5/2007 | Itoh et al. | 340/539.23 |
| 7,843,327 | B1 | 11/2010 | DiMartino et al. | |

OTHER PUBLICATIONS

Office Action dated Mar. 1, 2010, U.S. Appl. No. 12/116,046.
Notice of Allowance dated Jul. 27, 2010, U.S. Appl. No. 12/116,046.

* cited by examiner

*Primary Examiner* — Tai T Nguyen

(57) ABSTRACT

A method of monitoring a portable electronic device electronically is provided. The method comprises receiving a first radio signal, the first radio signal emitted by the electronically monitored portable electronic device and determining a first received signal strength of the first radio signal. The method also comprises receiving a second radio signal, the second radio signal emitted by the electronically monitored portable electronic device, the second radio signal received after the first radio signal. The method also comprises determining a second received signal strength of the second radio signal, comparing the second received signal strength to the first received signal strength, and alerting when a result of the comparing exceeds a threshold.

13 Claims, 6 Drawing Sheets

FIG. 5
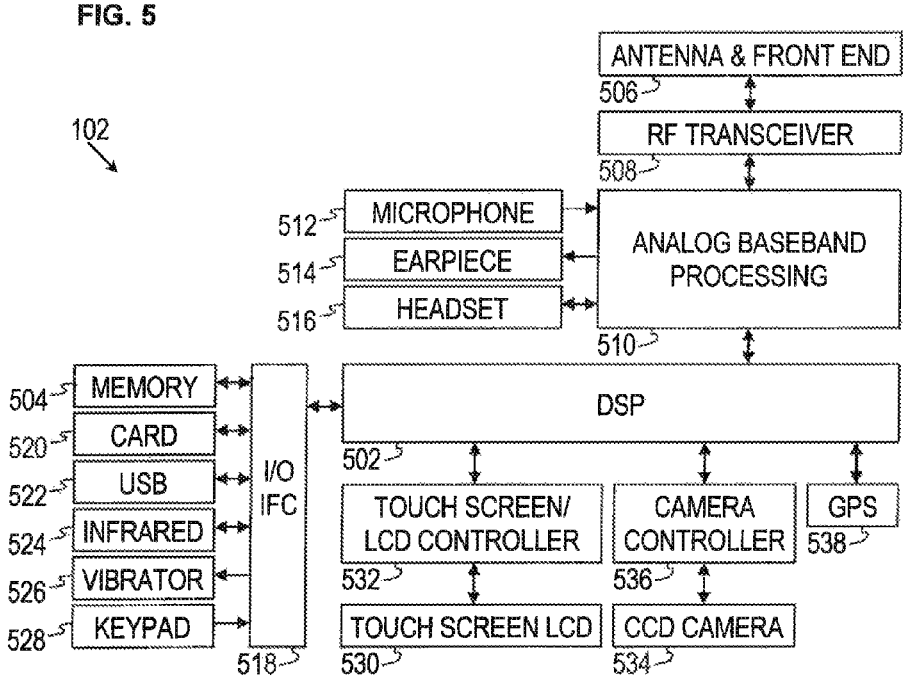
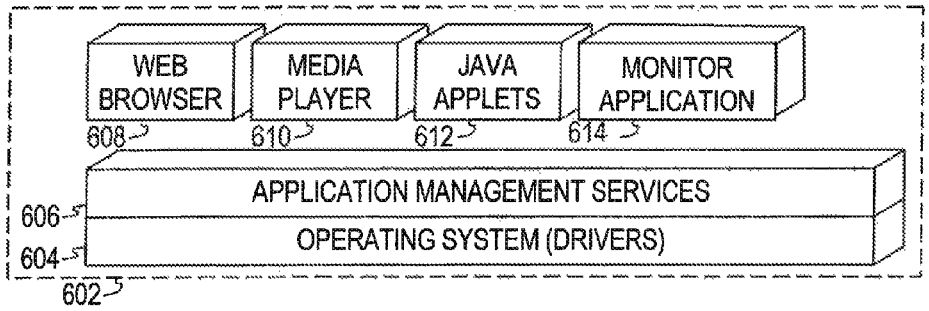
FIG. 6

PROXIMITY DETECTION AND ALERTING

CROSS-REFERENCE TO RELATED APPLICATIONS

This application is a continuation of and claims priority to U.S. patent application Ser. No. 12/116,046 issued as U.S. Pat. No. 7,843,327 on Nov. 30, 2010, entitled "Proximity Detection and Alerting," by Allison A. DiMartino, et al., filed on May 6, 2008, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Broadcast radio frequency signal strength degrades or attenuates as it crosses a physical distance. The degradation of an unimpeded radio signal is mathematically predictable, based on the radio propagation environment. Increased distance and decreased signal strength are closely related. When an unobstructed radio signal of known originating strength is received and measured by a receiving station, the approximate distance from the transmitting station can be assessed. Objects which intervene between the transmitting and receiving stations disturb the mathematics of the signal decay function. Determining distance from a transmitter based on measuring signal strength inside of buildings and other crowded or cluttered places is problematic as randomly disposed obstructions may diminish signal strength in unpredictable ways.

SUMMARY

In an embodiment, a method of monitoring a portable electronic device electronically is provided. The method comprises receiving a first radio signal, the first radio signal emitted by the electronically monitored portable electronic device and determining a first received signal strength of the first radio signal. The method also comprises receiving a second radio signal, the second radio signal emitted by the electronically monitored portable electronic device, the second radio signal received after the first radio signal. The method also comprises determining a second received signal strength of the second radio signal, comparing the second received signal strength to the first received signal strength, and alerting when a result of the comparing exceeds a threshold.

In another embodiment, an electronic monitoring system is provided. The system comprises a portable electronic device having a radio transmitting a radio signal. The system also comprises a monitoring station having a radio receiver to receive the radio signal, having a processor to determine a first signal characteristic of the received radio signal, to determine a second signal characteristic of the received radio signal, to determine a parameter based on a comparison of the second signal characteristic to the first signal characteristic, and to determine when the parameter exceeds a range threshold. The monitoring station also has an output device to alert when the parameter exceeds the range threshold. The electronic monitoring system promotes the portable electronic device being electronically monitored with respect to the monitoring station.

In another embodiment, a monitoring system is provided. The monitoring system comprises a satellite device configured to be attachable to one of a human being to be monitored and an animal to be monitored, the satellite device comprising a radio transceiver, the radio transceiver transmitting a radio signal to promote ranging the satellite device. The system also comprises a monitor in radio communication with the satellite device and configured to determine a satellite device range, to determine when the satellite device range exceeds the threshold range, and to present an alert when the satellite device range exceeds the threshold range.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 5 is a block diagram of a mobile device according to an embodiment of the disclosure.

FIG. 6 is a block diagram of a software configuration for a mobile device according to an embodiment of the disclosure.

DETAILED DESCRIPTION

Figure 1:
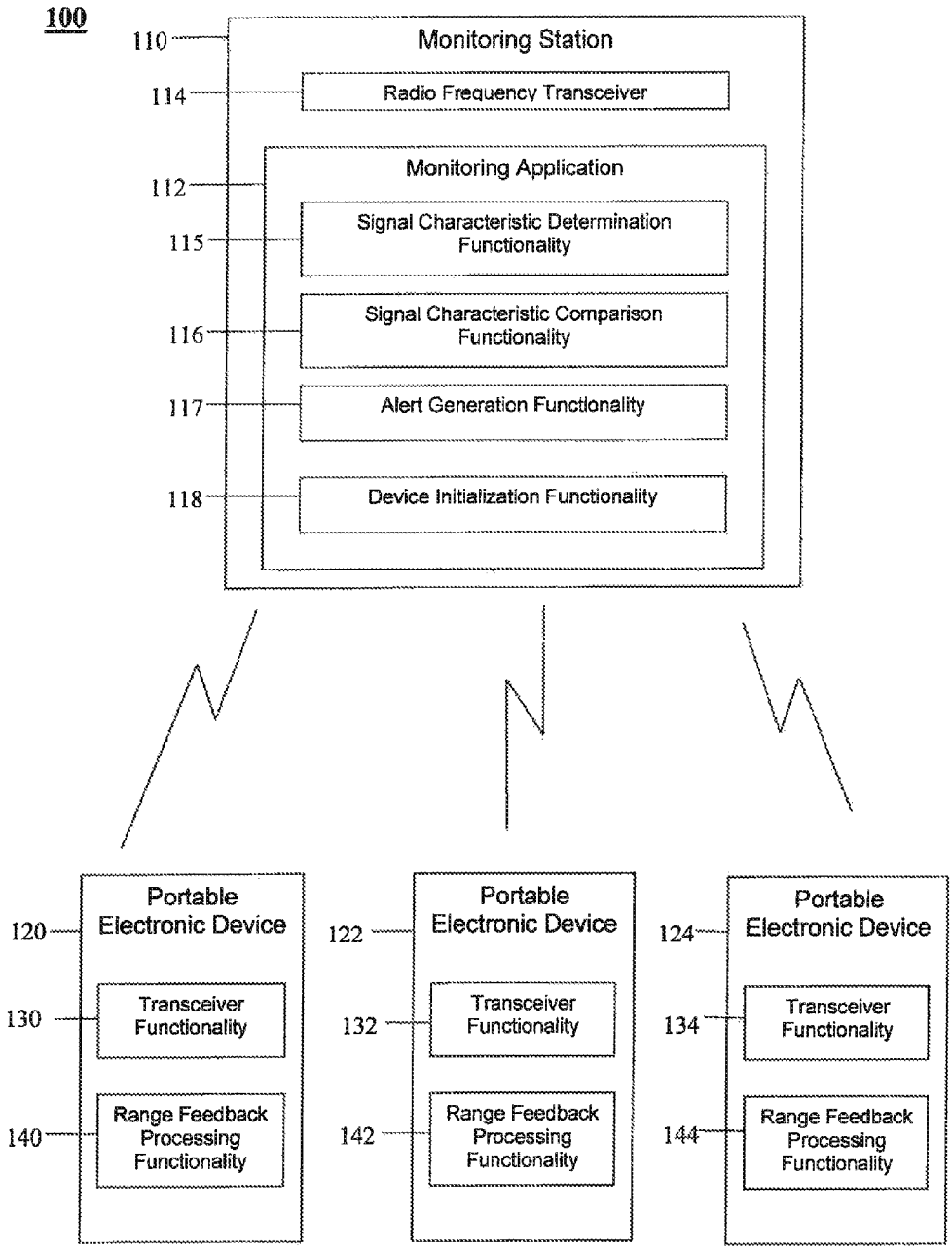
FIG. 1 is a block diagram of a system according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Several embodiments of a proximity detection and alerting system are taught. In one embodiment, the proximity detection and alerting system permits a retailer of mobile telephones and other portable electronic devices to display products for sale in a retail outlet store without physically tethering the display items, thereby enhancing the overall customer experience. Other embodiments of the proximity detection and alerting system promote a parent or other caregiver to electronically maintain a child or animal within a close proximity without using a physical tether or leash. Embodiments of the system include a monitoring device which repeatedly receives radio signals and measures the change in signal strength between radio signals received. The embodiments also include a portable electronic device, for example a mobile phone in a retail store or a satellite device attached to a child or animal which repeatedly transmit radio signals to the monitoring device.

By comparing the change in signal strength between radio signals received from the portable electronic device or the satellite device, the monitoring device is able to determine that the portable electronic device or the satellite device is either remaining within a predefined allowable range from the monitoring device, approaching the edge of, or moving outside of the predefined allowable range. It is understood that at least some of the objects of the present invention may be obtained without determining a specific physical distance between the monitoring device and the portable electronic device or satellite device. Herein, the term ranging and/or allowable range is not intended to be linked with or imply determination of definite physical distance. For example, the allowable range of a portable electronic device and/or a satellite device from a monitoring station, in a particular radio environment, may be irregularly shaped about a central point. When the change in signal strength between received signals exceeds a predefined tethering or range threshold, this indicates to the monitoring device that the portable electronic device or satellite device may have moved outside of the predefined allowable range. It is understood that "exceeding a threshold" can be used to refer to a ratio dropping below a minimum value, for example a ratio of a second received signal strength to a first received signal strength dropping below a minimum value. The monitoring device may present an alert message to clerks or security personnel in a retail store or a parent or other caregiver of a child or animal, notifying them that the threshold has been exceeded and corrective action may be required. In an embodiment, the individual holding the portable electronic device or the child or animal fitted with the satellite device may also be prompted by output of the portable electronic device or of the satellite device to move back within the predefined allowable range.

In an embodiment, prospective customers in a retail store may wish to handle portable electronic devices on display, such as mobile telephones, without the nuisance of the display item being physically tethered by wire, cord or chain to shelving. By enabling a portable electronic device to regularly send radio signals to a monitoring device on site at the retail outlet store, clerks and/or security personnel may be alerted by the monitoring device when a prospective customer's movements with an untethered portable electronic device results in a signal strength change exceeding a threshold. In an embodiment, the monitoring device may transmit an alert message to a portable electronic device, for example a mobile phone or a personal digital assistant, associated with a clerk and/or security personnel, for example in case the clerk or security personnel is not close to the monitoring device.

Providing range feedback to the portable electronic device may promote prospective customers maintaining the desired proximity to the monitoring station and/or the display base, which may be referred to, in some contexts, as self-policing. A customer who is discretely informed that he is approaching a boundary of the allowable distance from a display area is expected to appreciate receiving this information to save themselves the possible embarrassment of being politely informed by a clerk or security person to stay closer to the display area. The portable electronic device may present the boundary proximity indication in a variety of forms, for example by low frequency vibrations or low volume audio tones. Range feedback sent to the portable electronic devices and the resultant customer self-policing may effectively diminish possible problems associated with an irregular pattern of signal strength attenuation at different points within a store environment, for example resulting from metal structures blocking or attenuating radio propagation. Permitting a prospective customer to freely handle an untethered portable electronic device enhances the prospective customer's overall experience with the device and may increase the retail store's chances of completing a sale transaction. In another embodiment, a parent responsible for a small child or children in a public place such as a retail store, shopping mall, amusement park, or airport has the child's safety as a primary concern but also must conduct shopping, purchase tickets, hear announcements and otherwise attend to the primary business at that venue. Owners of animals such as dogs have a similar concern when outdoors, for example at a public park. By fitting the child or animal with a satellite device that regularly sends radio signals to a monitoring device held by the adult, the monitoring device, by measuring changes in received signal strength, may alert the parent or other caregiver that the child or animal has moved outside of an allowed range from the adult or other caregiver.

Embodiments of the proximity detection and alerting system do not require or use global positioning system (GPS) technology, triangulation, or other absolute geographic location services, and may provide particular benefit in indoor environments. Further, in a store environment, with a child as an example, clear line of sight, which in many instances may correlate to signal strength, is potentially more relevant to a parent than physical or geographic location. For example, a parent situated only five feet away from a child but separated by a high wall is of much greater concern than being separated by twenty feet but with a clear view.

Turning to FIG. 1, a system 100 for providing electronic tethering comprises a monitoring station 110, a monitoring application 112, and a portable electronic device 120. In most embodiments the system 100 may comprise additional portable electronic devices 122, 124.

The monitoring station 110 may be any general purpose computer system, as discussed in greater detail hereinafter. The monitoring station 110 may comprise one computer or a plurality of computers. The monitoring station 110 receives radio signals from one or more portable electronic devices 120, 122, 124 and processes received radio signals. The monitoring station 110 comprises a radio frequency transceiver 114 promoting the monitoring station 110 to receive radio ranging signals from portable electronic devices 120, 122, 124 and send range feedback to the portable electronic devices 120, 122, 124 as necessary. In some embodiments, the system 100 may comprise more than one monitoring station 110, each monitoring station 110 performing the tasks described above. In some circumstances, multiple monitoring stations 110 may provide greater reliability and/or may promote appropriate sharing of security functions among retail store personnel, for example.

The monitoring application 112 comprises a signal characteristic determination functionality 115 which determines one or more signal characteristic of radio signals received from the portable electronic devices 120, 122, 124, for example a signal strength and/or a signal propagation delay. The monitoring application 112 also comprises signal characteristic comparison functionality 116 that may determine a ratio or change of a second radio signal characteristic compared to a first or an initial radio signal characteristic. The signal characteristic comparison functionality 116 compares the radio signals to determine when a tethering threshold has been exceeded, indicating that the portable electronic devices 120, 122, 124 may have been moved beyond an allowable range, possibly necessitating corrective action. The monitoring application 112 also comprises alert generation functionality 117 which may present alerts on a monitor and/or send alerts to store clerks and security personnel.

The alert generation functionality 117 may also generate instructions to the radio frequency transceiver 114 to send prompts to the portable electronic devices 120, 122, 124, for example to cause the portable electronic devices 120, 122, 124 to present a distinctive and noticeable tone or voice message to return to the display area. This behavior of the portable electronic devices 120, 122, 124 may be distinct from the more discreet presentation of range feedback that gently informs the customer that they are approaching the range boundary. At the point that the alert generation functionality 117 needs to send a prompt to the radio frequency transceiver 114 to send prompts to the portable electronic devices 120, 122, 124, the customer has not been diligently practicing self-policing and may need to be reminded to return the portable electronic devices 120, 122, 124 to the display. The distinctive and noticeable tone or voice message may also promote the clerks and/or security personnel quickly and readily locating the portable electronic devices 120, 122, 124 to assist them in retrieving the portable electronic devices 120, 122, 124.

The radio signal characteristic that is determined may include signal strength, signal propagation time and/or other. The tethering threshold or range threshold is expressed as a change in signal characteristic between a second radio signal and a first radio signal, for example an initialization radio signal, received from the portable electronic devices 120, 122, 124. The tethering threshold or range may be set by the monitoring application 112. The monitoring application 112 also comprises device initialization functionality 118 which initializes the portable electronic devices 120, 122, 124 in the system 100, a process completed at regular intervals such as hourly, daily, or weekly and may involve recalibrating to adjust for normal power signal strength variations and circuitry degradation. In an embodiment, the monitoring application 112 may periodically request the portable electronic devices 120, 122, 124 to conduct an initialization handshake when the portable electronic devices 120, 122, 124 are next returned to their display position or bases. The portable electronic devices 120, 122, 124 may determine that they have returned to their display position by, for example, determining their proximity to an RFID tag placed near their normal display position or by recoupling to a docking station in their display position or by other mechanisms.

The portable electronic devices 120, 122, 124 may be one of a mobile telephone, personal digital assistant, media player, digital camera, and/or other handheld electronic device. In an embodiment, the portable electronic devices 120, 122, 124 are displayed for customer viewing and handling at a retail outlet store. The portable electronic devices 120, 122, 124 comprise transceiver functionality 130, 132, 134, respectively. At intervals, the transceiver functionality 130, 132, 134 emits a radio signal at a substantially uniform strength. The radio signal is emitted at a frequency that is detectable by the monitoring station 110 and may be one of a WiFi radio signal, a Bluetooth radio signal, an industrial, scientific, and medical band (ISM) signal, and/or other. In an embodiment the portable electronic devices 120, 122, 124 are maintained in a powered-on state while on display for examination and testing by prospective customers. The portable electronic devices 120, 122, 124 also comprise range feedback receiving functionality 140, 142, 144 which may receive range feedback from the monitoring station 110 and present ranging information to the prospective customer handling the portable electronic devices 120, 122, 124, informing the prospective customer of their proximity to the tethering threshold or ranging threshold. This range feedback information may be presented as audio indications and/or vibration indications and/or visual indications on a display of the portable electronic devices 120, 122, 124. In an embodiment, the presentation of range feedback information may increase in amplitude as the portable electronic devices 120, 122, 124 approach more closely to the tethering threshold or range threshold, for example a discrete audio beeping that increases in frequency as the tethering threshold or range threshold is approached. The range feedback receiving functionality 140, 142, 144 may also generate and present the distinctive and noticeable tone or voice message to return to the display area when the portable electronic devices 120, 122, 124 move beyond the tethering threshold or ranging threshold.

In an embodiment, the portable electronic devices 120, 122, 124 are not physically tethered to shelving, cradling or any store display structure and is instead free to be handled by prospective customers and carried about on the store premises within an allowed range from the shelving where the portable electronic devices 120, 122, 124 normally rest, for example in a display area or a display position. As mentioned above, as used herein the terms range, ranging, and/or allowable range are not intended to be linked with or imply determination of definite physical distance of the portable electronic devices 120, 122, 124 from the monitoring station 110 or from another reference point. Range, ranging, and/or allowable range are determined based on comparison of an initialization first signal and a second signal. In an embodiment, if the ratio of a received strength of the second signal to the received strength of the first signal drops below a range threshold, the portable electronic devices 120, 122, 124 are determined to have passed beyond the allowable threshold and should return closer to the monitoring station 110 and/or the display area. As will be readily appreciated, if intervening metal structures partially block the radio propagation pathway between the portable electronic devices 120, 122, 124 and the monitoring station 110, the allowable tethering threshold or range threshold may be crossed at a physical distance that is closer to the monitoring station 110 than would be the case if no intervening metal structures were present. Randomly disposed structures in the radio environment of the portable electronic devices 120, 122, 124 and the monitoring station 110 may result in an irregularly disposed boundary of the tethering threshold or range threshold. Notwithstanding, the disclosed proximity detection and system 100 may be an effective and simple improvement for securing portable electronic devices 120, 122, 124 while promoting a better interactive product experience for customers.

When a prospective customer is able to handle the portable electronic devices 120, 122, 124 free of physical tethering, the prospective customer may more easily appreciate the dimensions, weight, styling, features, and overall look and feel of the device. Younger buyers of mobile telephones and other portable electronic devices place greater emphasis on stylistic features and view these devices as lifestyle statements. A prospective customer may want to experience how a mobile phone feels in his pocket or fits into her purse, for example. The richer interaction made possible by physically untethering the portable electronic devices 120, 122, 124 may allow the customer to better appreciate the technical, practical, and aesthetic benefits of the portable electronic devices 120, 122, 124 and may improve the likelihood that the prospective customer will complete a purchase.

In an embodiment, a derivative or a derivative-like parameter may be calculated based on two or more samples of the signal strength. For example, a first derivative parameter may be calculated as the ratio of the signal strength change to the time change. This first parameter may be calculated as the difference of the signal strength at a first sample time minus the signal strength at a second sample time divided by the difference of sample time two minus sample time one, which may be represented symbolically as:

$$\text{First parameter}=(SS_1-SS_2)/(T_2-T_1) \quad \text{(Equation 1)}$$

where $SS_2$ is the signal strength at sample time two $T_2$, and $SS_1$ is the signal strength at sample time one $T_1$. Note that the polarity of the calculation of the difference between the signal strengths is deliberately chosen to provide a positive value of the first parameter when the signal strength is decreasing. This polarity is chosen so that when the value of the first parameter is larger than a positive valued threshold, an alert event may be determined. So long as the appropriate adjustments are made in determining the alert event, the first parameter may be calculated according to any polarity, and the difference in signal strength may be calculated by reversing the position of $SS_1$ and $SS_2$ in Equation 1. It may be said that any alternative organizations or orderings of equation 1, for example changing signs and/or polarities of the components of equation 1, are nevertheless still based on equation 1. In an embodiment, a second derivative or second derivative-like parameter may be calculated based on two or more calculated values of the first parameter or based on several values of the signal strength. For example, the second derivative parameter may be calculated as the difference of the first parameter at a fourth sample time minus the first parameter at a third sample time divided by the difference of sample time four minus sample time three, which may be represented symbolically as:

$$\text{Second parameter}=(D1_2-D1_1)/(T_4-T_3) \quad \text{(Equation 2)}$$

where $D1_2$ is the first parameter, or first derivative-like parameter, at sample time four $T_4$ and $D1_1$ is the first parameter at sample time three $T_3$. In some contexts, the first parameter may be referred to as a velocity parameter and the second parameter may be referred to as an acceleration parameter. In combination with the present disclosure, one skilled in the art will readily identify alternative manners of calculating a time rate of change of the signal strength (first parameter) and of calculating a time rate of change of the time rate of change of the signal strength (second parameter), all of which are contemplated by the present disclosure. In some embodiments, it may be useful to average or exponentially smooth the calculated values of the first parameter and the second parameter, for example to attenuate noise or to obtain a more accurate indication of the general trend of change. In some embodiments, it may be useful to reverse the polarity of the first parameter, because the condition of interest is a relatively rapidly decreasing signal strength, which corresponds to a negative value of the first parameter as defined above.

In an embodiment, if the first parameter exceeds a threshold, the monitoring station 110 may generate an alert event. In an embodiment, if the second parameter exceeds a threshold, the monitoring station 110 may generate an alert event. In an embodiment, a formula, equation, or algorithm may be used to determine an alert event. The formula, equation, or algorithm may be based on two or more of the signal ratio, the rate of change of the signal strength with respect to time (first parameter), and the time rate of change of the rate of change of the signal strength with respect to time (second parameter).

In an embodiment, an alert event may also occur with the observation of an absolute level of signal strength. The monitoring station 110 may be configured to generate an alert when signal strength received falls to an absolute, fixed level. A signal strength reaching this level may indicate, for example, that the portable electronic devices 120, 122, 124 are no longer inside the retail store building. Each of the value of the signal strength, the ratio of signal strengths, the time rate of change of signal strength (first parameter), and the time rate of change of the time rate of change of signal strength (second parameter) may be used to determine an alert event.

Figure 2:
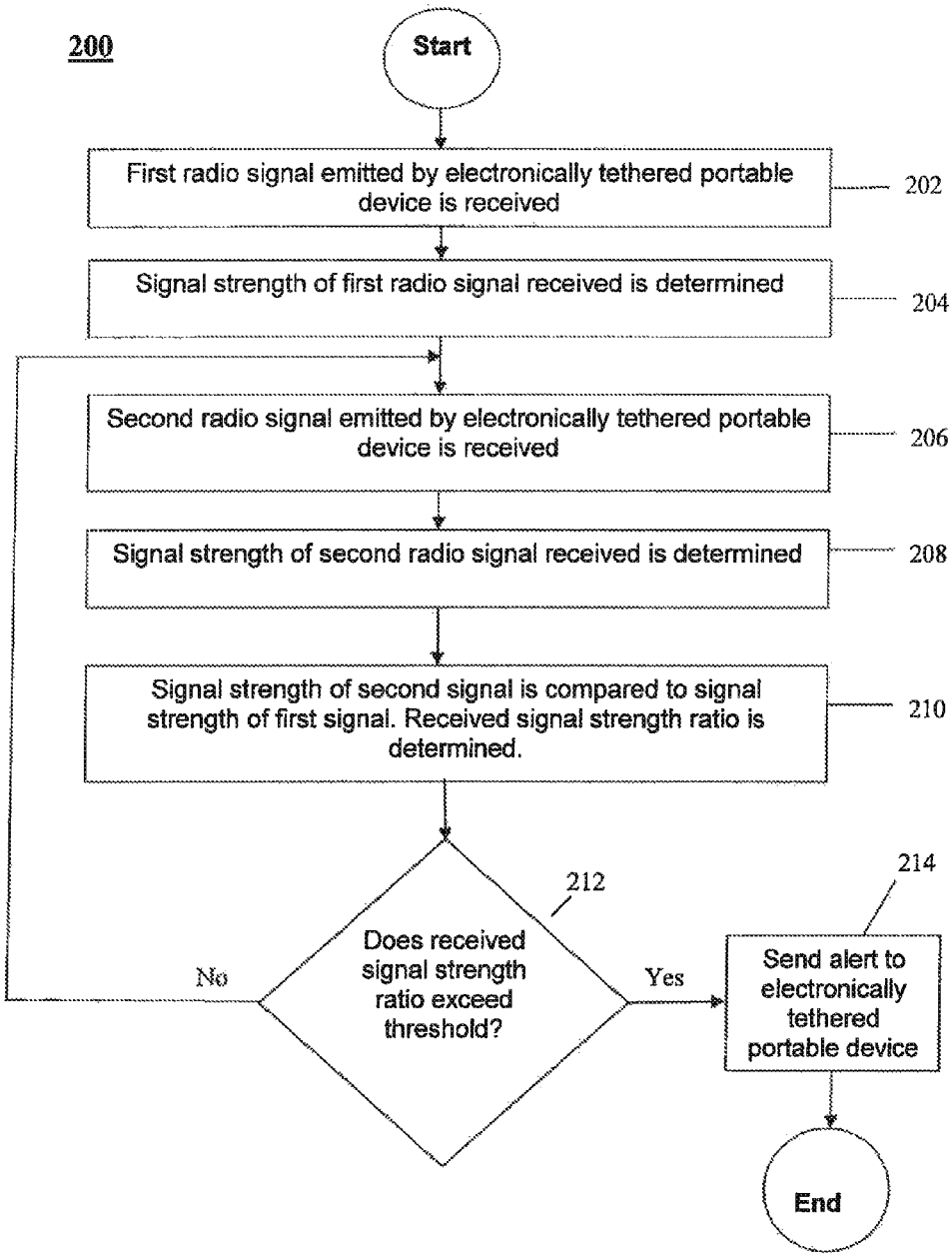
FIG. 2 is a flow chart illustrating a method according to an embodiment of the disclosure.

Turning now to FIG. 2, a method 200 of proximity detection and alerting is discussed. The method 200 may also be referred to as a method of monitoring a portable electronic device. The method begins at block 202, where the monitoring station 110 receives a first radio signal emitted by the portable electronic devices 120, 122, 124. The first radio signal is an initialization signal emitted while the portable electronic devices 120, 122, 124 are stowed in its display location. In an embodiment, a process of device initialization may take place once per day, for example, perhaps as part of a retail store opening procedure. Store personnel may calibrate the monitoring station 110 and the portable electronic devices 120, 122, 124 and establish the strength of the first radio signal for that day. In the embodiment, the first radio signal, as established, is used as the reference or basis signal in the method 200 in calculating changes in signal strength as received from the portable electronic devices 120, 122, 124 during that day. At block 204, the monitoring station 110 determines the strength of the first radio signal emitted by the portable electronic devices 120, 122, 124.

It will be readily appreciated that several methods of initialization may be used by the method 200. For example, the monitoring station 110 may send a message to the portable electronic devices 120, 122, 124 at intervals throughout a business day requesting the portable electronic devices 120, 122, 124 to reinitialize the capturing of a basis signal strength corresponding to the first radio signal. This may permit the monitoring station 110 to correct for changes in radio emission power of the portable electronic devices 120, 122, 124 throughout the day. Note that in an embodiment having multiple portable devices 120, 122, 124, for example a retail store selling mobile phones where as many as one hundred or more portable devices 120, 122, 124 may be present, the monitoring station 110 may conduct initialization with each of the portable electronic devices 120, 122, 124 and store the first radio signal or basis signal associated with each of these portable electronic devices 120, 122, 124, since the signal strength of the first radio signal or basis signal may differ from one portable electronic devices 120, 122, 124 to another.

In another embodiment, however, it may be the case that each of the portable electronic devices 120, 122, 124 are known or assumed to transmit with equal radio signal strength, and only one of the portable electronic devices 120, 122, 124 are requested to complete the initialization. In an embodiment, a part of initialization may be determining or configuring a tethering threshold or range threshold by transmitting a radio signal from the portable electronic devices 120, 122, 124 from a suitable boundary location. For example, at the start of the day, store personnel may cause the monitoring station 110 to initiate a threshold configuration mode and cause one of the portable electronic devices 120, 122, 124 to emit the radio signal from a position at about the appropriate boundary threshold. The monitoring station 110 may receive the radio signal from the electronic devices 120, 122, 124 and store the signal strength as a tethering threshold or range threshold basis or reference. Alternatively, the monitoring station 110 may determine the ratio between the initialization signal strength at the range threshold and the first signal and store only the ratio.

At block 206, the monitoring station 110 receives a second radio signal emitted by the portable electronic devices 120, 122, 124. During a business day, prospective customers may handle the portable electronic devices 120, 122, 124 while examining its features and attributes. The portable electronic devices 120, 122, 124 repeatedly send the second radio signal to the monitoring station 110. At block 208, the monitoring station 110 determines the strength of the second radio signal emitted by the portable electronic device.

At block 210, the monitoring station 110 compares the strength of the first received signal to the strength of the second received signal. Since the strength of the first radio signal was earlier established and is a known point of reference, the received strength of the second radio signal as measured by the monitoring station 110 may indicate whether the portable electronic devices 120, 122, 124 are within or not within the predetermined allowable range. As described above, the term allowable range, range, and threshold range are not intended to imply or be linked with determination of a definite physical distance. Physical objects and electromagnetic interference which intervene between transmitting and receiving stations may disrupt radio signal transmission and cause measurements of second radio signal strength to vary independently of distance. For example, inside a retail store, display racking and shelving as well as electromagnetic interference from other devices and appliances may cause received the received signal strength to vary even when distance of the portable electronic devices 120, 122, 124 from the monitoring station 110 is equal.

At block 212, the monitoring station 110 determines whether the ratio of the signal strength of the first and second received signals exceeds the tethering threshold or range threshold.

If the ratio of the signal strength of the first and second received signals exceeds the allowed threshold as determined at block 212, the method proceeds to block 214 whereupon the monitoring station 110 notifies applicable personnel that the portable electronic devices 120, 122, 124 have been moved outside of the allowed range. The prospective customer handling the portable electronic devices 120, 122, 124 may be prompted by the portable electronic devices 120, 122, 124 to move back within the allowed range. In some cases, if the portable electronic devices 120, 122, 124 moves back within the allowed range, the method 200 will resume its normal process of checking beginning at block 206. The portable electronic devices 120, 122, 124 also may present a loud and distinct alert to assist clerks and/or security personnel in recovering the portable electronic devices 120, 122, 124. If the ratio of the first and second received signals does not exceed the allowed threshold as determined at block 212, the method returns to block 202 where it begins again. It will be readily appreciated that in normal operation the method 200 may repeatedly loop through the block 206 through block 212.

In an embodiment, as the prospective customer carrying the portable electronic devices 120, 122, 124 walk farther from the monitoring station 110 and hence closer to the edge of the allowed range within which the portable electronic devices 120, 122, 124 may be carried, the portable electronic devices 120, 122, 124 receives range feedback and may present a form of the range feedback to the prospective customer, for example by emitting one of an increasing volume of an audible tone, an increasing on-off frequency of an audible tone, an increasing on-off frequency of a vibration and increasing on-off frequency of a visual indication. The portable electronic devices 120, 122, 124 may present range feedback in other forms, for example as a visual indication on a display, a number indicating an approximate distance from the range threshold, a color from green to yellow to red, or some other indication of the proximity to the range threshold. It is to be understood that if the visual indication comprises an approximate distance from the range threshold that the distance information may be only relatively accurate and may be subject to distance errors. Providing range feedback to the portable electronic devices 120, 122, 124 may promote self-policing on the part of customers and may help the customers avoid embarrassment should they exceed the tethering threshold or range threshold. The self-policing by honest customers that can be anticipated to result from presenting the ranging feedback on the portable electronic devices 120, 122, 124 may also reduce the burden on clerks and/or security personnel at a retail store to respond to alerts and or alarms.

Figure 3:
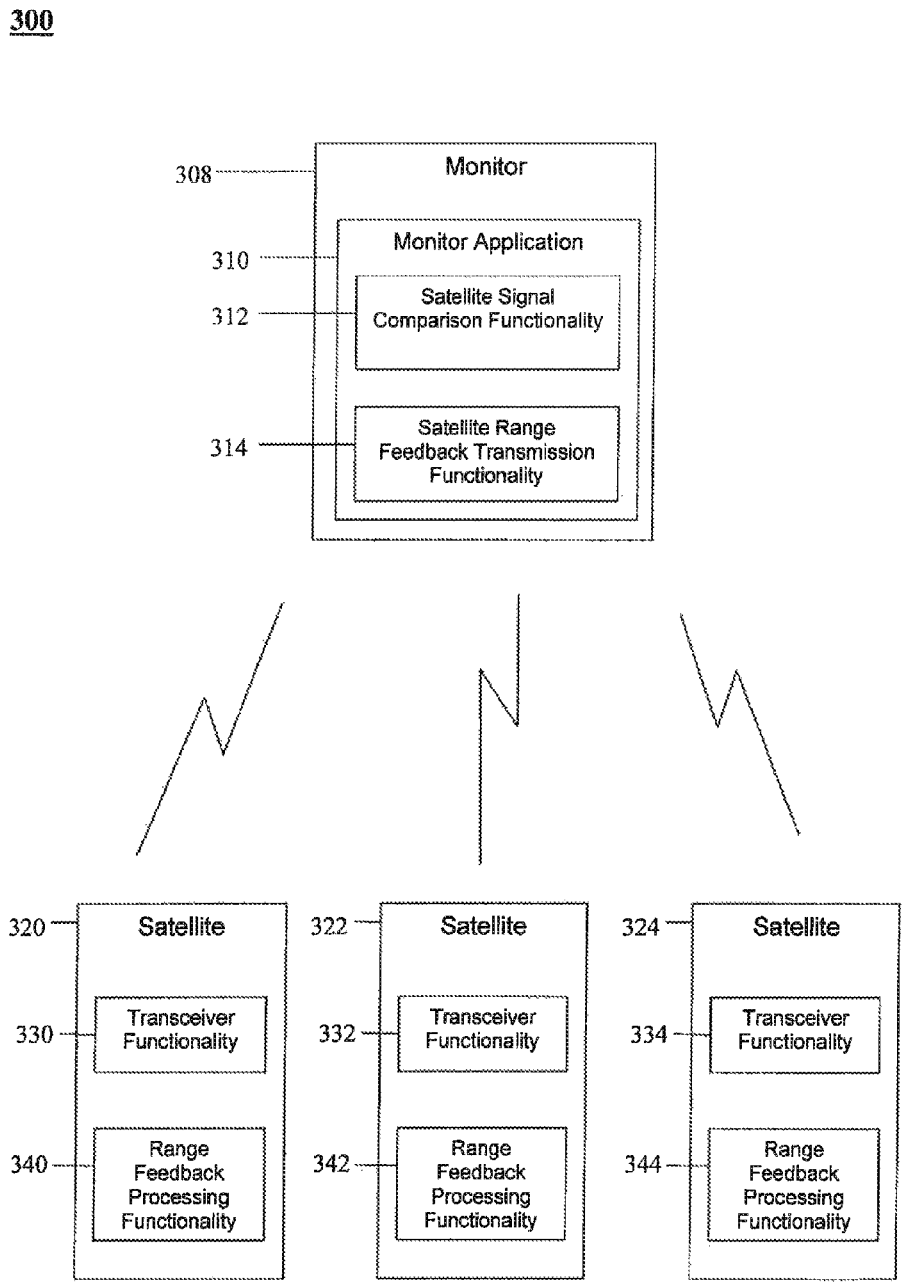
FIG. 3 is a block diagram of another system according to an embodiment of the disclosure.

Turning now to FIG. 3, a system 300 for providing electronic tethering is discussed. The system comprises a monitor 308, a monitor application 310, and satellite devices 320, 322, 324.

In an embodiment, the monitor 308 may be a mobile phone, personal digital assistant or other electronic device. The monitor application 310 resides on the monitor 308 and comprises a satellite signal comparison functionality 312 that provides for comparing different signals received from the satellite devices 320, 322, 324 and a satellite ranging feedback functionality 314 that promotes transmitting ranging feedback to the satellite devices 320, 322, 324.

The satellite devices 320, 322, 324 may each be an electronic device capable of emitting radio signals. The satellite devices 320, 322, 324 may also receive prompts from the monitor application 310. The satellite devices 320, 322, 324 comprise transceiver functionality 330, 332, 334, respectively and range feedback processing functionality 340, 342, 344, respectively. While the satellite devices 320, 322, 324 may be dedicated to the sole purpose described herein to accompany a child and contain the above functionality, the satellite devices 320, 322, 324 in an embodiment may be a multipurpose device such as a mobile handset or a personal digital assistant (PDA) with the above functionality incorporated therein. The satellite devices 320, 322, 324 in an embodiment may be an interactive game unit with the above functionality incorporated therein. The satellite devices 320, 322, 324 may be in a child-friendly form factor such as children's mobile telephones with simplified keypads and attaching mechanisms.

In an embodiment, the satellite devices 320, 322, 324 are attachable to or can otherwise be associated with one of a human being or an animal to be monitored. The transceiver functionality 330, 332, 334 emits radio signals at substantially uniform signal strength and at a frequency detectable by the monitor application 310. Each of the satellite devices 320, 322, 324 may generate a radio signal strength that is specific and unique to that particular unit during a particular frame of time. The system 300 includes a regular process of device initialization in which the monitor application 310 and the satellite devices 320, 322, 324 are calibrated and a first radio signal strength is established. The process of initialization is completed at regular intervals, for example daily. The first radio signal strength that is established becomes the reference or basis signal strength for that particular frame of time until the next initialization takes place and is relevant only for the specific device and frame of time. In an embodiment, each satellite devices 320, 322, and 324 may initialize independently. In another embodiment, however, it may be possible to operate the system 300 based on only one of the satellite devices 320, 322, and 324 transmitting the first radio signal during initialization. In an embodiment, the monitor application 310 may be able to configure a threshold signal strength, for example by capturing a radio signal strength received while one of the satellite devices 320, 322, 324 is located at about a threshold range. In different environments, the user of the monitor application 310, for example a mother with children, may prefer to establish different range thresholds.

In the embodiment the monitor application 310 receives radio signals from the satellite devices 320, 322, 324. As the strength of the radio signal emitted by the satellite devices 320, 322, 324 is known and as a radio signal emitted by the satellite devices 320, 322, 324 attenuates or degrades, the strength of the second radio signal received by the monitor application 310 is indicative of the proximity of the satellite devices 320, 322, 324 to the boundary of the predetermined allowed range. As discussed above, the term ranging and/or allowable range is not intended to be linked with or imply determination of definite physical distance. This indication, which may be combined with the determined radio signal propagation time from the satellite devices 320, 322, 324 to the monitor 308, permits the satellite signal comparison functionality 312 to determine the proximity of the satellite devices 320, 322, 324 to the boundary of the predetermined allowed range.

The monitor application 310 receives a first radio signal followed by a second radio signal from the satellite devices 320, 322, 324. The monitor application 310 evaluates the first radio signal and the second radio signal by the received signal strength and/or the propagation time of each radio signal. By comparing signal strengths and/or propagation times of the first radio signal and the second radio signal the monitor application 310 may determine if the child or animal fitted with the satellite devices 320, 322, 324 has moved to a range that exceeds the predetermined allowed range, the threshold range. If the satellite signal comparison functionality 312 determines that the calculated satellite range exceeds the threshold range, the monitor application 310 will present an alert to the parent or other caregiver responsible for the child or animal. The monitor application 310, using its satellite range feedback transmission functionality 314, may also transmit range feedback to the satellite devices 320, 322, 324. The child or animal fitted with the satellite devices 320, 322, 324, which includes range feedback processing functionality 340, 342, 344, may receive a stimulus to move back within the threshold range. In some embodiments, however, no range feedback is transmitted from the monitor 308 to the satellite devices 320, 322, 322, no stimulus to move back within the threshold range is provided, and no range feedback processing functionality 340, 342, 344 is provided. In this embodiment, the operator of the monitor 308 uses the ranging information, including alerts presented by the monitor 308 when the child and/or animal exceeds the allowable range threshold, to determine that they need to call out to their children or otherwise remind them to stay closer. This embodiment may provide a more streamlined, lower cost, more robust design than a system 300 that promotes sending either range feedback and/or stimulus to the satellite devices 320, 322, 324. In part, this embodiment may tacitly assume that the children and/or animals being monitored with the system 300 will blithely ignore the stimulus and/or range feedback.

Figure 4:
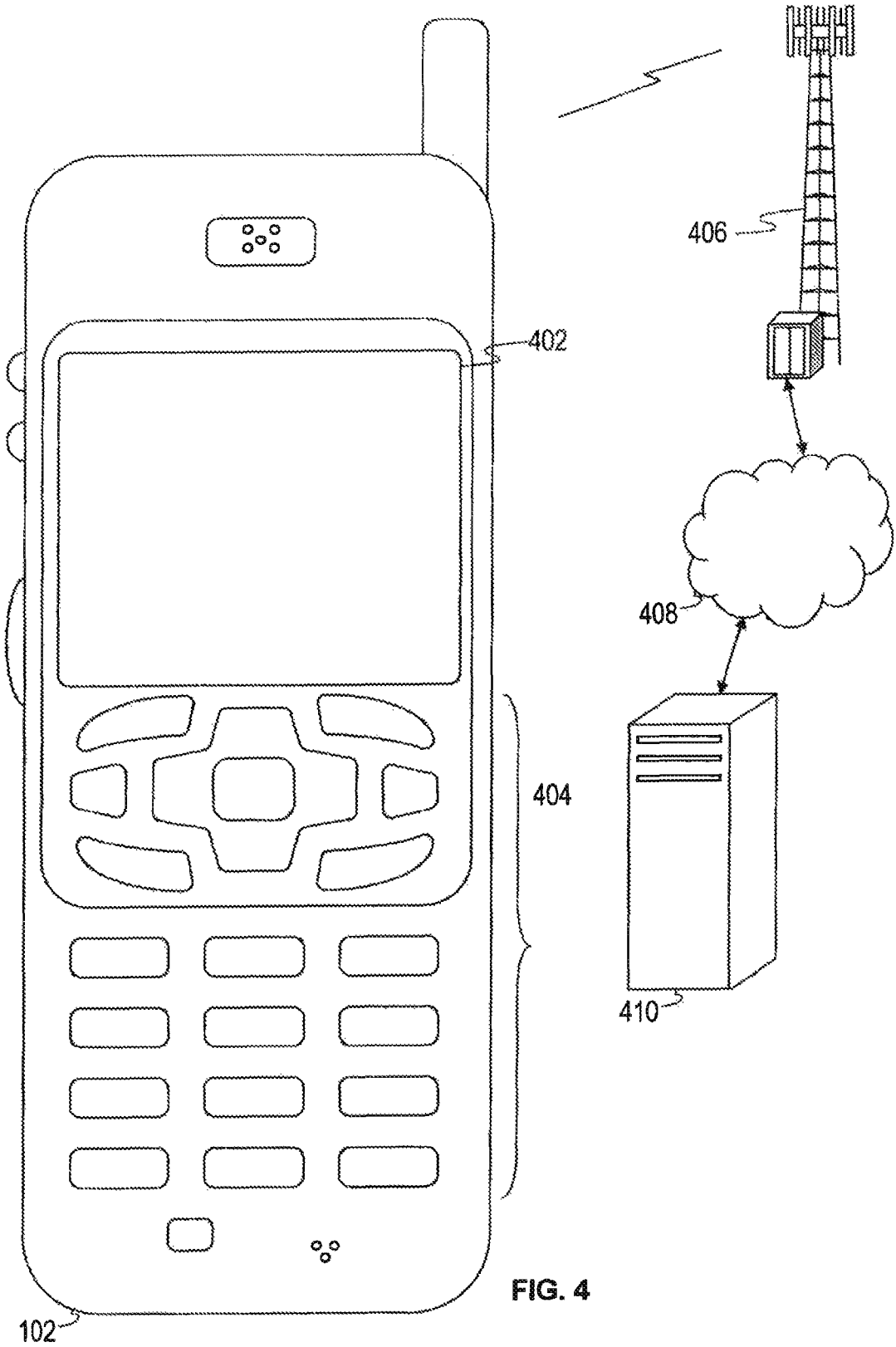
FIG. 4 is an illustration of a mobile device according to an embodiment of the disclosure.

FIG. 4 shows a wireless communications system including the handset 102. FIG. 4 depicts the handset 102, which is operable for implementing aspects of the present disclosure, but the present disclosure should not be limited to these implementations. In different embodiments, the monitoring station 110, the portable electronic devices 120, 122, 124, the monitor 308, and the satellite devices 320, 322, 324 may include some, all, or more functionality than the exemplary handset 102. Though illustrated as a mobile phone, the handset 102 may take various forms including a wireless handset, a pager, a personal digital assistant (PDA), a portable computer, a tablet computer, or a laptop computer. Many suitable handsets combine some or all of these functions. In some embodiments of the present disclosure, the handset 102 is not a general purpose computing device like a portable, laptop or tablet computer, but rather is a special-purpose communications device such as a mobile phone, wireless handset, pager, or PDA. The handset 102 may support specialized activities such as gaming, inventory control, job control, and/or task management functions, and so on.

The handset 102 includes a display 402 and a touch-sensitive surface or keys 404 for input by a user. The handset 102 may present options for the user to select, controls for the user to actuate, and/or cursors or other indicators for the user to direct. The handset 102 may further accept data entry from the user, including numbers to dial or various parameter values for configuring the operation of the handset 102. The handset 102 may further execute one or more software or firmware applications in response to user commands. These applications may configure the handset 102 to perform various customized functions in response to user interaction. Additionally, the handset 102 may be programmed and/or configured over-the-air, for example from a wireless base station, a wireless access point, or a peer handset 102.

The handset 102 may execute a web browser application which enables the display 402 to show a web page. The web page may be obtained via wireless communications with a cell tower 406, a wireless network access node, a peer handset 102 or any other wireless communication network or system. The cell tower 406 (or wireless network access node) is coupled to a wired network 408, such as the Internet. Via the wireless link and the wired network, the handset 102 has access to information on various servers, such as a server 410. The server 410 may provide content that may be shown on the display 402. Alternately, the handset 102 may access the cell tower 406 through a peer handset 102 acting as an intermediary, in a relay type or hop type of connection.

FIG. 5 shows a block diagram of the handset 102. While a variety of known components of handsets 102 are depicted, in an embodiment a subset of the listed components and/or additional components not listed may be included in the handset 102. The handset 102 includes a digital signal processor (DSP) 502 and a memory 504. As shown, the handset 102 may further include an antenna and front end unit 506, a radio frequency (RF) transceiver 508, an analog baseband processing unit 510, a microphone 512, an earpiece speaker 514, a headset port 516, an input/output interface 518, a removable memory card 520, a universal serial bus (USB) port 522, an infrared port 524, a vibrator 526, a keypad 528, a touch screen liquid crystal display (LCD) with a touch sensitive surface 530, a touch screen/LCD controller 532, a charge-coupled device (CCD) camera 534, a camera controller 536, and a global positioning system (GPS) sensor 538. In an embodiment, the handset 102 may include another kind of display that does not provide a touch sensitive screen. In an embodiment, the DSP 502 may communicate directly with the memory 504 without passing through the input/output interface 518.

The DSP 502 or some other form of controller or central processing unit operates to control the various components of the handset 102 in accordance with embedded software or firmware stored in memory 504 or stored in memory contained within the DSP 502 itself. In addition to the embedded software or firmware, the DSP 502 may execute other applications stored in the memory 504 or made available via information carrier media such as portable data storage media like the removable memory card 520 or via wired or wireless network communications. The application software may comprise a compiled set of machine-readable instructions that configure the DSP 502 to provide the desired functionality, or the application software may be high-level software instructions to be processed by an interpreter or compiler to indirectly configure the DSP 502.

The antenna and front end unit 506 may be provided to convert between wireless signals and electrical signals, enabling the handset 102 to send and receive information from a cellular network or some other available wireless communications network or from a peer handset 102. In an embodiment, the antenna and front end unit 506 may include multiple antennas to support beam forming and/or multiple input multiple output (MIMO) operations. As is known to those skilled in the art, MIMO operations may provide spatial diversity which can be used to overcome difficult channel conditions and/or increase channel throughput. The antenna and front end unit 506 may include antenna tuning and/or impedance matching components, RF power amplifiers, and/or low noise amplifiers.

The RF transceiver 508 provides frequency shifting, converting received RF signals to baseband and converting baseband transmit signals to RF. In some descriptions a radio transceiver or RF transceiver may be understood to include other signal processing functionality such as modulation/demodulation, coding/decoding, interleaving/deinterleaving, spreading/despreading, inverse fast fourier transforming (IFFT)/fast fourier transforming (FFT), cyclic prefix appending/removal, and other signal processing functions. For the purposes of clarity, the description here separates the description of this signal processing from the RF and/or radio stage and conceptually allocates that signal processing to the analog baseband processing unit 510 and/or the DSP 502 or other central processing unit. In some embodiments, the RF transceiver 508, portions of the antenna and front end 506, and the analog baseband processing unit 510 may be combined in one or more processing units and/or application specific integrated circuits (ASICs).

The analog baseband processing unit 510 may provide various analog processing of inputs and outputs, for example analog processing of inputs from the microphone 512 and the headset port 516 and outputs to the earpiece speaker 514 and the headset port 516. To that end, the analog baseband processing unit 510 may have ports for connecting to the built-in microphone 512 and the earpiece speaker 514 that enables the handset 102 to be used as a cell phone. The analog baseband processing unit 510 may further include a port for connecting to a headset or other hands-free microphone and speaker configuration. The analog baseband processing unit 510 may provide digital-to-analog conversion in one signal direction and analog-to-digital conversion in the opposing signal direction. In some embodiments, at least some of the functionality of the analog baseband processing unit 510 may be provided by digital processing components, for example by the DSP 502 or by other central processing units.

The DSP 502 may perform modulation/demodulation, coding/decoding, interleaving/deinterleaving, spreading/despreading, inverse fast fourier transforming (IFFT)/fast fourier transforming (FFT), cyclic prefix appending/removal, and other signal processing functions associated with wireless communications. In an embodiment, for example in a code division multiple access (CDMA) technology application, for a transmitter function the DSP 502 may perform modulation, coding, interleaving, and spreading, and for a receiver function the DSP 502 may perform despreading, deinterleaving, decoding, and demodulation. In another embodiment, for example in an orthogonal frequency division multiplex access (OFDMA) technology application, for the transmitter function the DSP 502 may perform modulation, coding, interleaving, inverse fast fourier transforming, and cyclic prefix appending, and for a receiver function the DSP 502 may perform cyclic prefix removal, fast fourier transforming, deinterleaving, decoding, and demodulation. In other wireless technology applications, yet other signal processing functions and combinations of signal processing functions may be performed by the DSP 502.

The DSP 502 may communicate with a wireless network via the analog baseband processing unit 510. In some embodiments, the communication may provide Internet connectivity, enabling a user to gain access to content on the Internet and to send and receive e-mail or text messages. The input/output interface 518 interconnects the DSP 502 and various memories and interfaces. The memory 504 and the removable memory card 520 may provide software and data to configure the operation of the DSP 502. Among the interfaces may be the USB port 522 and the infrared port 524. The USB port 522 may enable the handset 102 to function as a peripheral device to exchange information with a personal computer or other computer system. The infrared port 524 and other optional ports such as a Bluetooth interface or an IEEE 802.11 compliant wireless interface may enable the handset 102 to communicate wirelessly with other nearby handsets and/or wireless base stations.

The input/output interface 518 may further connect the DSP 502 to the vibrator 526 that, when triggered, causes the handset 102 to vibrate. The vibrator 526 may serve as a mechanism for silently alerting the user to any of various events such as an incoming call, a new text message, and an appointment reminder.

The keypad 528 couples to the DSP 502 via the input/output interface 518 to provide one mechanism for the user to make selections, enter information, and otherwise provide input to the handset 102. Another input mechanism may be the touch screen LCD 530, which may also display text and/or graphics to the user. The touch screen LCD controller 532 couples the DSP 502 to the touch screen LCD 530.

The CCD camera 534 enables the handset 102 to take digital pictures. The DSP 502 communicates with the CCD camera 534 via the camera controller 536. The GPS sensor 538 is coupled to the DSP 502 to decode global positioning system signals, thereby enabling the handset 102 to determine its position. In another embodiment, a camera operating according to a technology other than charge coupled device cameras may be employed. Various other peripherals may also be included to provide additional functions, e.g., radio and television reception.

FIG. 6 illustrates a software environment 602 that may be implemented by the DSP 502. The DSP 502 executes operating system drivers 604 that provide a platform from which the rest of the software operates. The operating system drivers 604 provide drivers for the handset hardware with standardized interfaces that are accessible to application software. The operating system drivers 604 include application management services ("AMS") 606 that transfer control between applications running on the handset 102. Also shown in FIG. 6 are a web browser application 608, a media player application 610, and JAVA applets 612. The web browser application 608 configures the handset 102 to operate as a web browser, allowing a user to enter information into forms and select links to retrieve and view web pages. The media player application 610 configures the handset 102 to retrieve and play audio or audiovisual media. The JAVA applets 612 configure the handset 102 to provide games, utilities, and other functionality. The monitor application 614 depicted in FIG. 6 corresponds to the monitor application 310, a component of the system 300 and depicted in FIG. 3, a block diagram illustrating the system 300.

Figure 7:
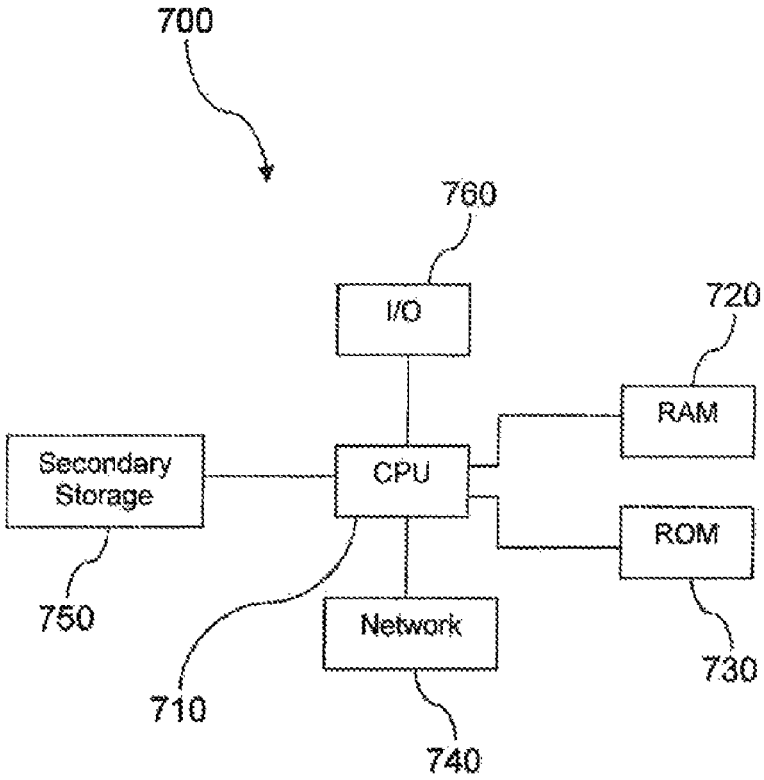
FIG. 7 illustrates an exemplary general purpose computer system suitable for implementing the several embodiments of the disclosure.

Aspects of the system 100 or the system 300 described above may be implemented on any general-purpose computer with sufficient processing power, memory resources, and network throughput capability to handle the necessary workload placed upon it. FIG. 7 illustrates a typical, general-purpose computer system suitable for implementing one or more embodiments disclosed herein. The computer system 700 includes a processor 710 (which may be referred to as a central processor unit or CPU) that is in communication with memory devices including secondary storage 750, read only memory (ROM) 730, random access memory (RAM) 720, input/output (I/O) devices 760, and network connectivity devices 740. The processor may be implemented as one or more CPU chips.

The secondary storage 750 is typically comprised of one or more disk drives or tape drives and is used for non-volatile storage of data and as an over-flow data storage device if RAM 720 is not large enough to hold all working data. Secondary storage 750 may be used to store programs which are loaded into RAM 720 when such programs are selected for execution. The ROM 730 is used to store instructions and perhaps data which are read during program execution. ROM 730 is a non-volatile memory device which typically has a small memory capacity relative to the larger memory capacity of secondary storage. The RAM 720 is used to store volatile data and perhaps to store instructions. Access to both ROM 730 and RAM 720 is typically faster than to secondary storage 750.

I/O devices 760 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 740 may take the form of modems, modem banks, ethernet cards, universal serial bus (USB) interface cards, serial interfaces, token ring cards, fiber distributed data interface (FDDI) cards, wireless local area network (WLAN) cards, radio transceiver cards such as code division multiple access (CDMA) and/or global system for mobile communications (GSM) radio transceiver cards, and other well-known network devices. These network connectivity devices 740 may enable the processor 710 to communicate with an Internet or one or more intranets. With such a network connection, it is contemplated that the processor 710 might receive information from the network, or might output information to the network in the course of performing the above-described method steps. Such information, which is often represented as a sequence of instructions to be executed using processor 710, may be received from and outputted to the network, for example, in the form of a computer data signal embodied in a carrier wave.

Such information, which may include data or instructions to be executed using processor 710 for example, may be received from and outputted to the network, for example, in the form of a computer data baseband signal or signal embodied in a carrier wave. The baseband signal or signal embodied in the carrier wave generated by the network connectivity devices 740 may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 710 executes instructions, codes, computer programs, scripts which it accesses from hard disk, floppy disk, optical disk (these various disk based systems may all be considered secondary storage 750), ROM 730, RAM 720, or the network connectivity devices 740. While only one processor 710 is shown, multiple processors may be present. Thus, while instructions may be discussed as executed by a processor, the instructions may be executed simultaneously, serially, or otherwise executed by one or multiple processors.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of electronically monitoring a portable electronic device displayed for sale in a retail store without physically tethering the portable electronic device to a display area to permit a prospective customer to freely handle the electronically monitored and physically un-tethered portable electronic device, comprising:

receiving a first radio signal emitted by the electronically monitored and physically un-tethered portable electronic device;

receiving a second radio signal emitted by the electronically monitored and physically un-tethered portable electronic device, the second radio signal received after the first radio signal;

comparing a signal characteristic of the first received radio signal to a signal characteristic of the second received radio signal to determine a signal characteristic ratio; and alerting when a result of comparing the signal characteristic ratio to a threshold exceeds the threshold.

2. The method of claim 1, wherein the signal characteristic is one of signal strength and signal propagation time.

3. The method of claim 2, further including:

transmitting a range information to the electronically monitored and physically un-tethered portable electronic device based on the result of the comparing to enable the electronically monitored and physically un-tethered portable electronic device to present the range information to the prospective customer.

4. The method of claim 3, wherein the range information provides an indication of how the electronically monitored and physically un-tethered portable electronic device is to discretely present at least one of a visual indication, an audio tone, and a vibration to the prospective customer to inform them that they are approaching a boundary of allowable distance from the display area.

5. The method of claim 1, wherein the first radio signal is received at a first time and the second radio signal is received at a second time, and wherein comparing the signal characteristic of the first received radio signal to the signal characteristic of the second received radio signal comprises determining a signal characteristic derivative based on a ratio of a difference between the signal characteristic of the first received signal and the signal characteristic of the second received signal and a difference between the second time and the first time.

6. The method of claim 1, wherein the alerting further comprises alerting an entity other than the electronically monitored and physically un-tethered portable electronic device and other than the prospective customer.

7. An electronic monitoring station for electronically monitoring a portable electronic device that transmits a plurality of radio signals, comprising:

a radio receiver configured to receive plurality of the one or more radio signals, a processor configured to determine a first signal characteristic of a received radio signal, to determine a second signal characteristic of a received radio signal, to determine a signal characteristic ratio based on a comparison of the second signal characteristic to the first signal characteristic, and to determine when the signal characteristic ratio exceeds a range threshold, and an output device to alert when the parameter exceeds the range threshold.

8. The electronic monitoring system of claim 7, wherein the first signal characteristic is a first received signal strength and the second signal characteristic is a second received signal strength, and the parameter is determined as the ratio of the second received signal strength to the first received signal strength.

9. The electronic monitoring system of claim 7, wherein the monitoring station is configured to electronically monitor a plurality of portable electronic devices.

10. The electronic monitoring system of claim 7, wherein the first signal characteristic is a first received signal strength received at a first time and the second signal characteristic is a second received signal strength received at a second time, and the processor is further configured to determine a signal strength derivative based on a ratio of the difference between the first received signal strength and the second received signal strength and the difference between the second time and the first time.

11. The electronic monitoring system of claim 7, wherein the first signal characteristic is a first signal strength and the second signal characteristic is a second signal strength.

12. The electronic monitoring system of claim 7, wherein the first signal characteristic is a first signal propagation time and the second signal characteristic is a second signal propagation time.

13. The electronic monitoring system of claim 7, wherein the range threshold is calibrated to correspond approximately to a distance between the portable electronic device and the monitoring station.

* * * * *